US009863054B2

(12) United States Patent
Fedor et al.

(10) Patent No.: US 9,863,054 B2
(45) Date of Patent: Jan. 9, 2018

(54) SYSTEMS AND METHODS FOR PREPARING AND PLATING OF WORK ROLLS

(71) Applicant: NEO INDUSTRIES, LLC, Portage, IN (US)

(72) Inventors: Michal Fedor, Košice (SK); Milan Smoleň, Valaliky (SK)

(73) Assignee: NEO Industries, LLC, Portage, IN (US)

( * ) Notice: Subject to any disclaimer, the term of this patent is extended or adjusted under 35 U.S.C. 154(b) by 120 days.

(21) Appl. No.: 14/504,002

(22) Filed: Oct. 1, 2014

(65) Prior Publication Data

US 2015/0096885 A1 Apr. 9, 2015

Related U.S. Application Data

(60) Provisional application No. 61/886,133, filed on Oct. 3, 2013.

(51) Int. Cl.
*C25D 17/02* (2006.01)
*C25D 17/04* (2006.01)
(Continued)

(52) U.S. Cl.
CPC ..... *C25D 17/02* (2013.01); *C23C 18/163* (2013.01); *C23C 18/168* (2013.01); *C23C 18/1628* (2013.01); *C23C 18/1676* (2013.01); *C25D 3/04* (2013.01); *C25D 17/04* (2013.01); *C25D 17/06* (2013.01); *C25D 21/02* (2013.01); *C25D 21/04* (2013.01)

(58) Field of Classification Search
None
See application file for complete search history.

(56) References Cited

U.S. PATENT DOCUMENTS 1,738,727 A 12/1929 Pike et al.
2,634,878 A 4/1953 Messinger et al.
(Continued)

FOREIGN PATENT DOCUMENTS

GB 752671 7/1956
GB 785693 11/1957

OTHER PUBLICATIONS

International Search Report and Written Opinion for PCT/US2014/058593 dated Jun. 22, 2015, 15 pgs.
(Continued)

*Primary Examiner* — Harry D Wilkins, III
(74) *Attorney, Agent, or Firm* — Brinks Gilson & Lione

(57) ABSTRACT

The present embodiments are directed to systems and methods for plating of work rolls. In one embodiment, a system includes an inner tank having an inner diameter dimensioned to receive a work roll, and an outer tank, wherein the inner tank is disposed coaxially within the outer tank. The inner tank and the outer tank may each include cylindrical shapes. A temperature regulating tank, positioned outside of the outer tank, may be in fluid communication with an annular space between the inner and outer tanks. An exhaust hood having a generally ring-shaped profile including a plurality of slots formed therein may suction fumes from the inner tank. An anode configuration also is disclosed, having a shunt incorporated into the anode, wherein current going to the anode passes through the shunt.

14 Claims, 16 Drawing Sheets

(51) Int. Cl.

| | |
|---|---|
| ***C25D 21/02*** | (2006.01) |
| ***C25D 21/12*** | (2006.01) |
| ***C25D 17/06*** | (2006.01) |
| ***C25D 3/04*** | (2006.01) |
| ***C25D 21/04*** | (2006.01) |
| ***C23C 18/16*** | (2006.01) |

(56) References Cited

U.S. PATENT DOCUMENTS 3,634,047 A * 1/1972 Faulkner ..... C25D 17/00 204/237
3,796,350 A * 3/1974 Van Hauter ..... E03D 9/04 222/389
4,102,770 A * 7/1978 Moriarty ..... C25D 21/10 204/212
4,123,358 A * 10/1978 Flagge ..... C02F 1/006 210/104
4,126,533 A * 11/1978 Lukyanchikov ..... C25D 5/08 204/224 R
5,884,490 A * 3/1999 Whidden ..... F25C 1/22 62/356
6,182,854 B1 * 2/2001 Jimenez ..... A23G 9/44 220/501
2003/0006133 A1 * 1/2003 Metzger ..... C25D 7/04 204/232
2006/0086739 A1 * 4/2006 Woodhouse ..... A47G 7/07 220/501

OTHER PUBLICATIONS

Partial International Search Report and Invitation to Pay Additional Fees for PCT/US2014/058593 dated Mar. 30, 2015, 7 pgs.

* cited by examiner

SYSTEMS AND METHODS FOR PREPARING AND PLATING OF WORK ROLLS

PRIORITY CLAIM

This invention claims the benefit of priority of U.S. Provisional Application Ser. No. 61/886,133, entitled "Systems and Methods for Preparing and Plating of Work Rolls," filed Oct. 3, 2013, the disclosure of which is hereby incorporated by reference in its entirety.

BACKGROUND

The present embodiments generally relate to systems and methods for plating of work rolls, and more specifically, to systems and methods that reduce the amount of chromic acid required to electroplate work rolls, to reduce the chance for worker injury during the process, and to enable real time quality control measurements.

Chrome plating has been employed as a technique for plating work rolls used for forming materials such as steel or aluminum. In chrome plating, a thin layer of chromium is electroplated onto the work rolls. Various advantages are provided by chrome plating the work rolls, including but not limited to a consistent surface finish on the work rolls, increased resistance to surface defects, reduced roll marks, and higher cleanliness of the strip. Further, chrome plated work rolls may last significantly longer than other work rolls, thereby reducing roll changes and mill downtime.

However, hexavalent chromium is a known carcinogen and is under scrutiny for use in the electroplating process. In many countries, there are specific limitations on the amount of chromic acid that can be used in a plating operation.

Further, positioning of work rolls within a tank, such as one having chromic acid, generally requires a user to maneuver the work roll and a busbar in awkward manners, typically manually. This can lead to relatively high instances of worker injury during the process.

SUMMARY

The present embodiments are directed to systems and methods for plating of work rolls. In one embodiment, a system comprises an inner tank having an inner diameter dimensioned to receive a work roll, and an outer tank, wherein the inner tank is disposed coaxially within the outer tank. The inner tank and the outer tank may each comprise cylindrical shapes.

In one embodiment, an annular space is formed between the inner tank and the outer tank, and temperature regulating fluid is disposed within the annular space. A temperature regulating tank may be provided, which is positioned outside of the outer tank, and which is in fluid communication with the annular space between the inner and outer tanks.

An exhaust hood may be disposed over a perimeter of the inner tank. The exhaust hood may comprise a generally ring-shaped profile having a plurality of slots formed therein to suction fumes from the inner tank.

In one embodiment, a chamber may be positioned within the inner tank. Introduction of a fluid into the chamber urges a surplus of a substance within the inner tank towards a main reservoir of the inner tank.

At least one actuator may be operatively disposed for incremental vertical positioning of a work roll within the inner tank. Further, at least one actuator may be operatively disposed for incremental horizontal positioning of a busbar adjacent to a work roll. In any of the embodiments, the system may comprise an anode having a shunt incorporated into the anode, wherein current going to the anode passes through the shunt.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1B:
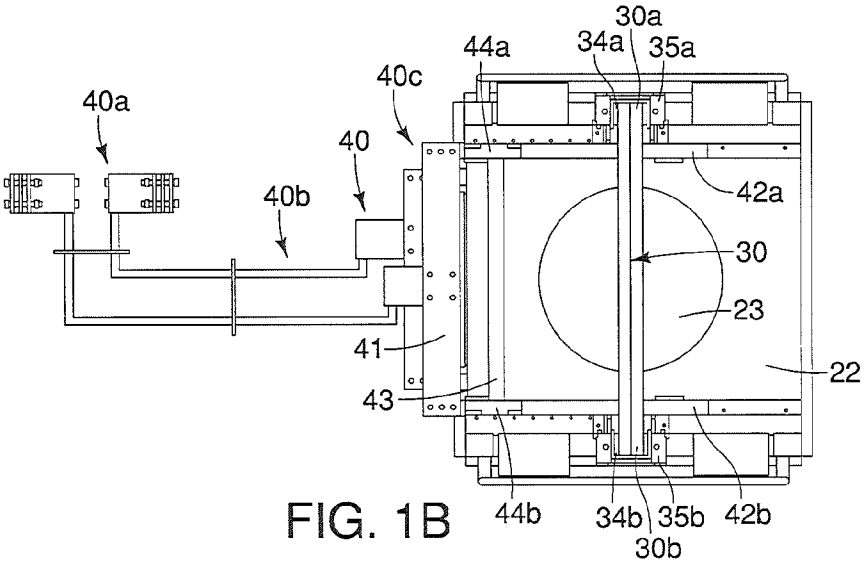
FIGS. 1A-1B are, respectively, perspective and top views of components of a first embodiment of a system for plating of work rolls.
Figure 1A:
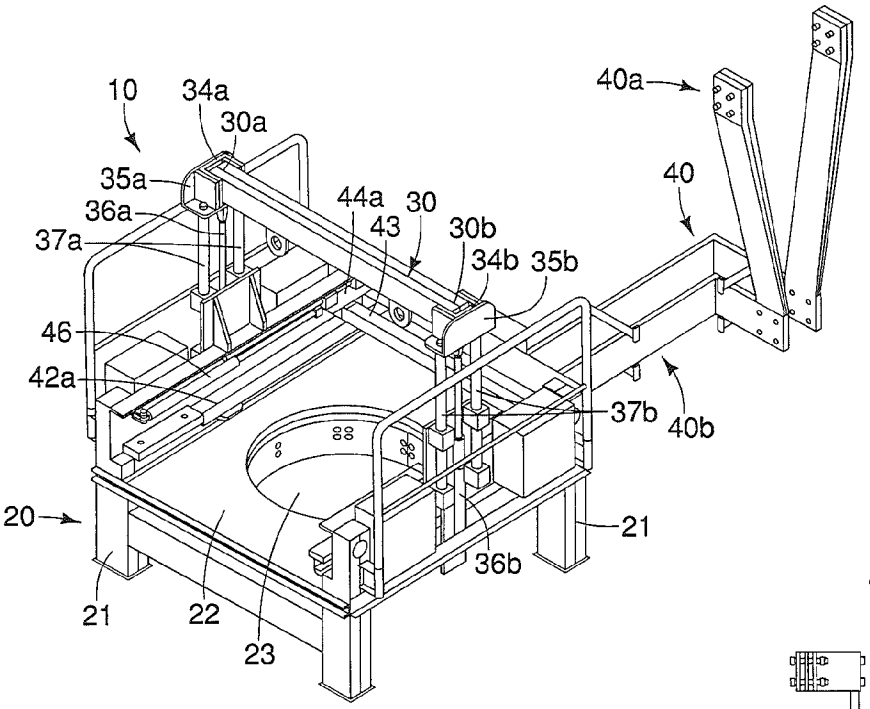

Referring to the drawings, a first embodiment of a system 10 for plating work rolls is shown and described. The system 10 comprises a supporting framework 20 having a plurality of legs 21 and a platform 22. An opening 23 is disposed in the platform 22, preferably near a central region of the platform 22, as seen in FIGS. 1A-1B.

Figure 2B:
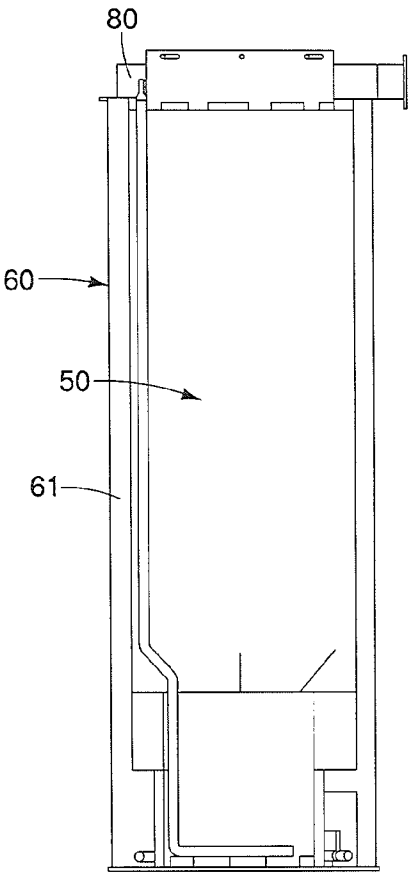
FIGS. 2A-2B are, respectively, a side view of an outer tank, and a side view of an inner tank disposed within the outer tank with portions of the outer tank cut-away for illustrative purposes.
Figure 2A:
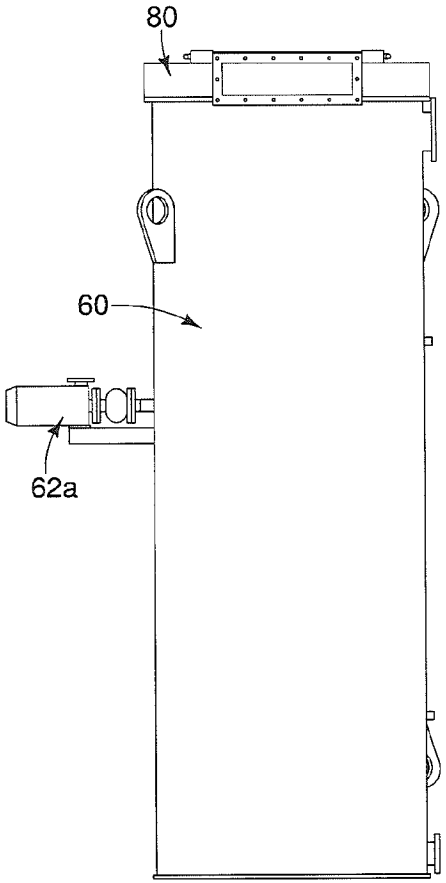
Figure 8:
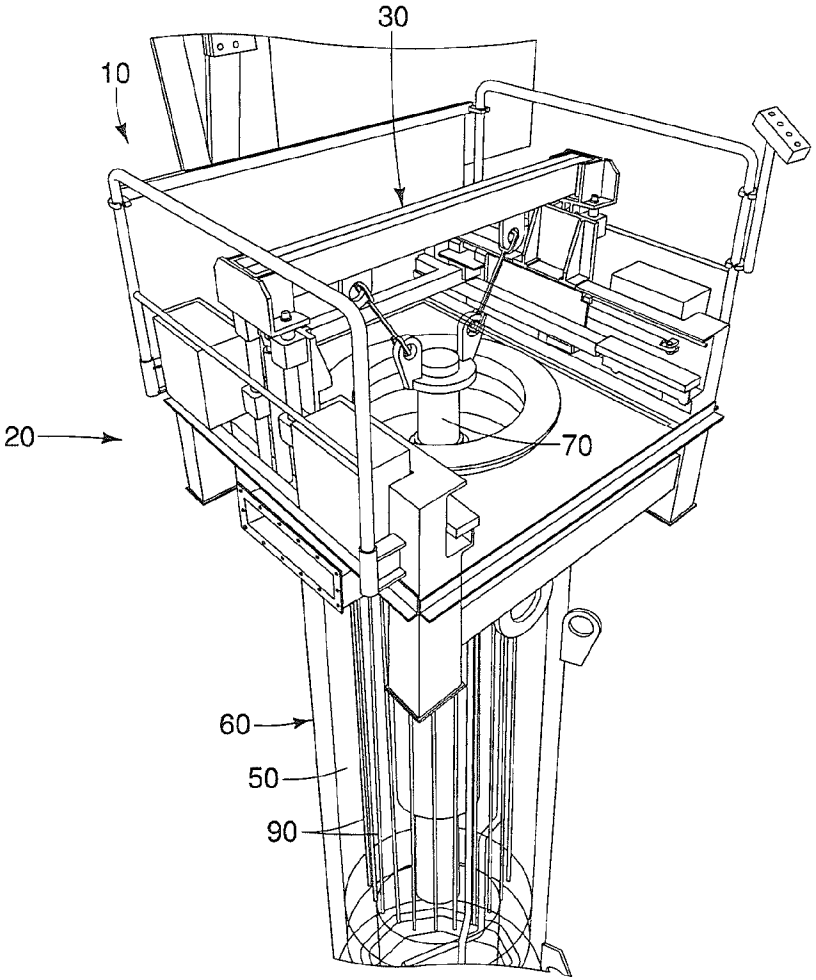
FIG. 8 is a perspective view of a work roll in the lowered position of FIG. 7, with portions of the inner and outer tanks cut-away for illustrative purposes.
Figure 9:
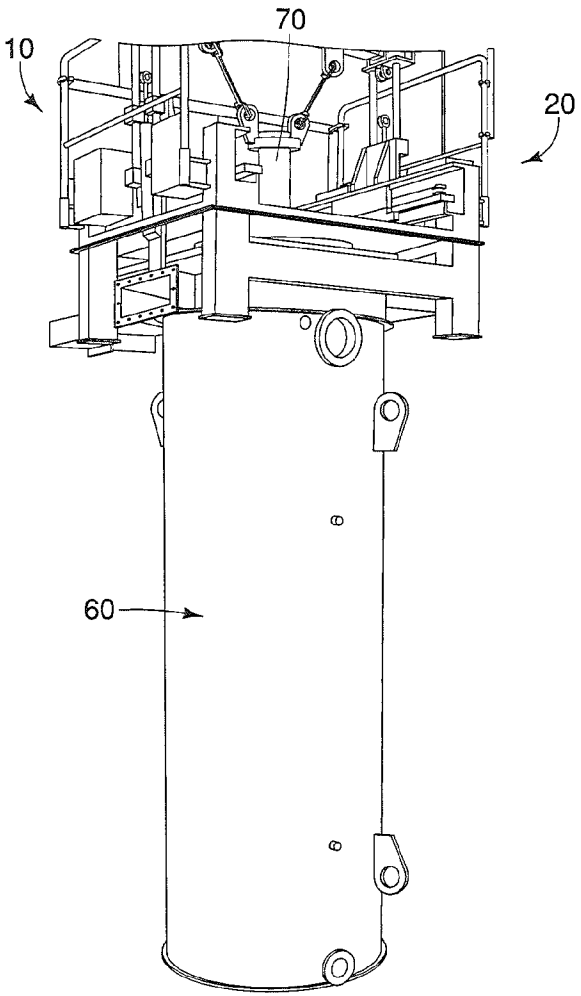
FIG. 9 is a schematic, perspective view of a work roll used with the system of the present embodiments.
Figure 10:
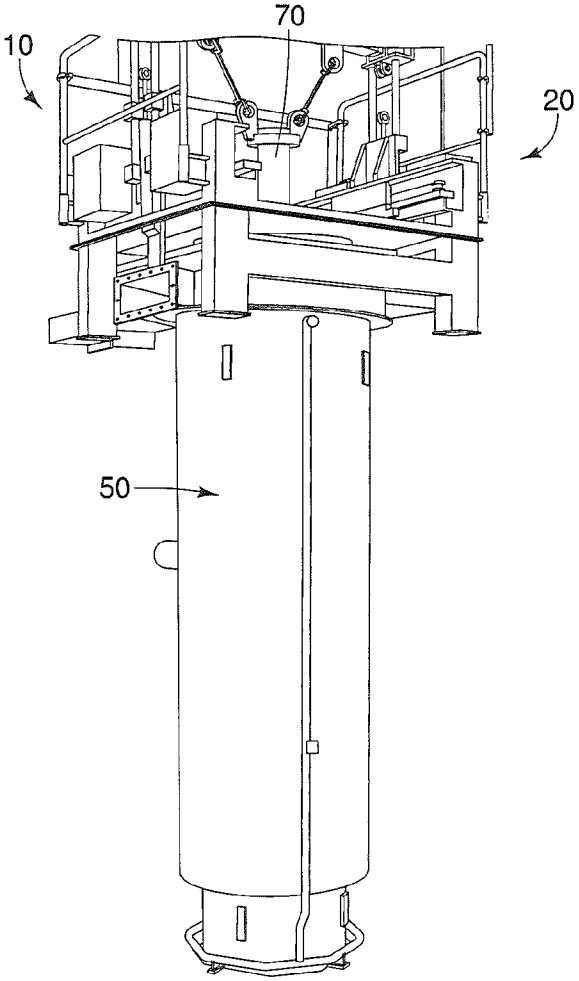
FIG. 10 is a schematic, perspective view with the outer tank of FIG. 9 being removed.

The system 10 preferably further comprises an inner tank 50 and an outer tank 60, as shown in FIGS. 2A-2B. The inner and outer tanks 50 and 60 are coaxially aligned with one another, as shown in FIG. 2B, and further are coaxially aligned with the opening 23 disposed in the platform 22 of the supporting framework 20, as depicted in FIG. 8 and explained in further detail below. An inner diameter of the inner tank 50 is dimensioned to receive a work roll 70, as explained and shown further below.

In accordance with one aspect of the present embodiments, the inner and outer tanks 50 and 60 each comprise a cylindrical shape. Advantageously, by providing inner and outer tanks 50 and 60 with cylindrical shapes, the amount of chromic acid disposed within the inner tank 50 and used in the plating operation is only approximately 1,000 gallons. In contrast, previously known tanks for plating of work rolls generally comprise rectangular shapes that require approximately 8,000 gallons of chromic acid. Therefore, by significantly reducing the amount of chromic acid used, the present embodiments afford a substantially more environmentally-friendly system for plating of work rolls.

In one embodiment, the inner tank 50 is manufactured from titanium. Advantageously, the beneficial properties of titanium for use with chromic acid are applied in a novel manner with such a vertically-oriented work roll plating system. Further, in one embodiment, the outer tank 60 is manufactured from steel.

Figure 6:
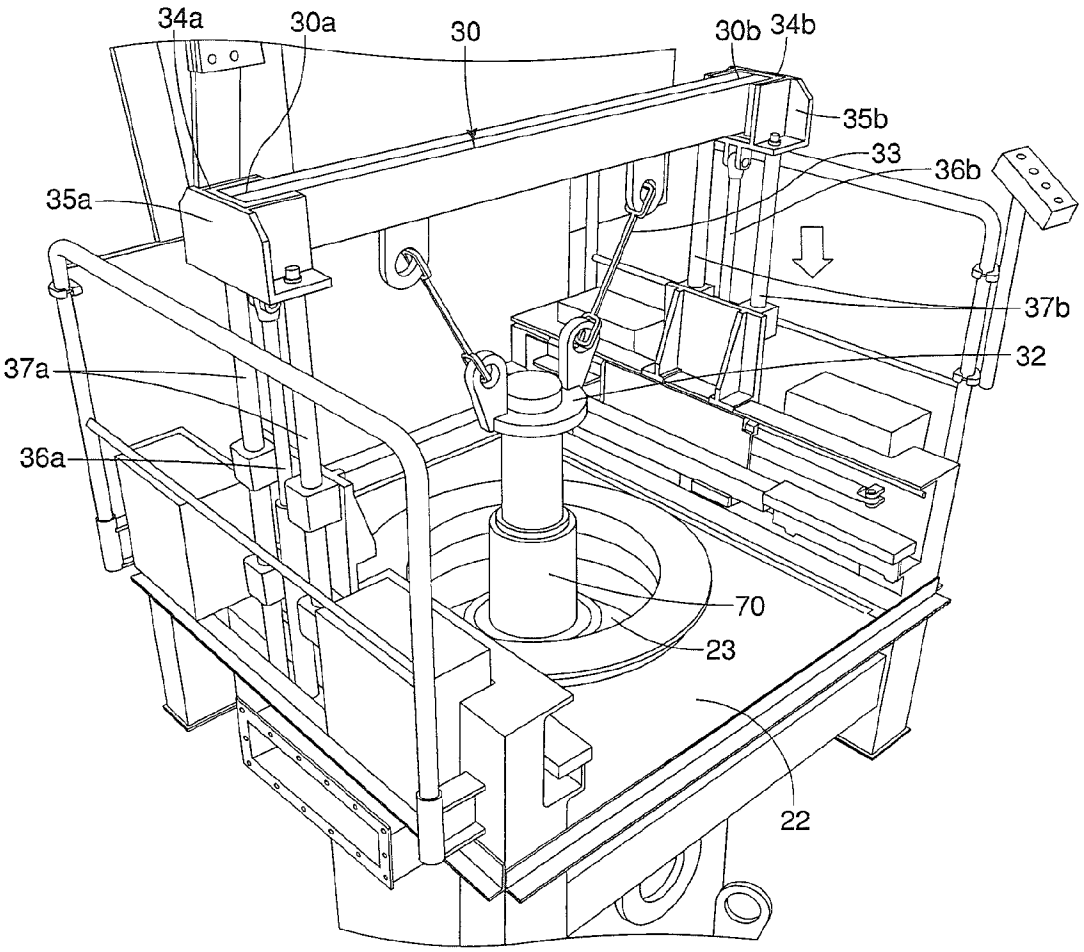
FIGS. 6-7 are, respectively, schematic perspective views of a work roll in elevated and lowered positions.
Figure 7:
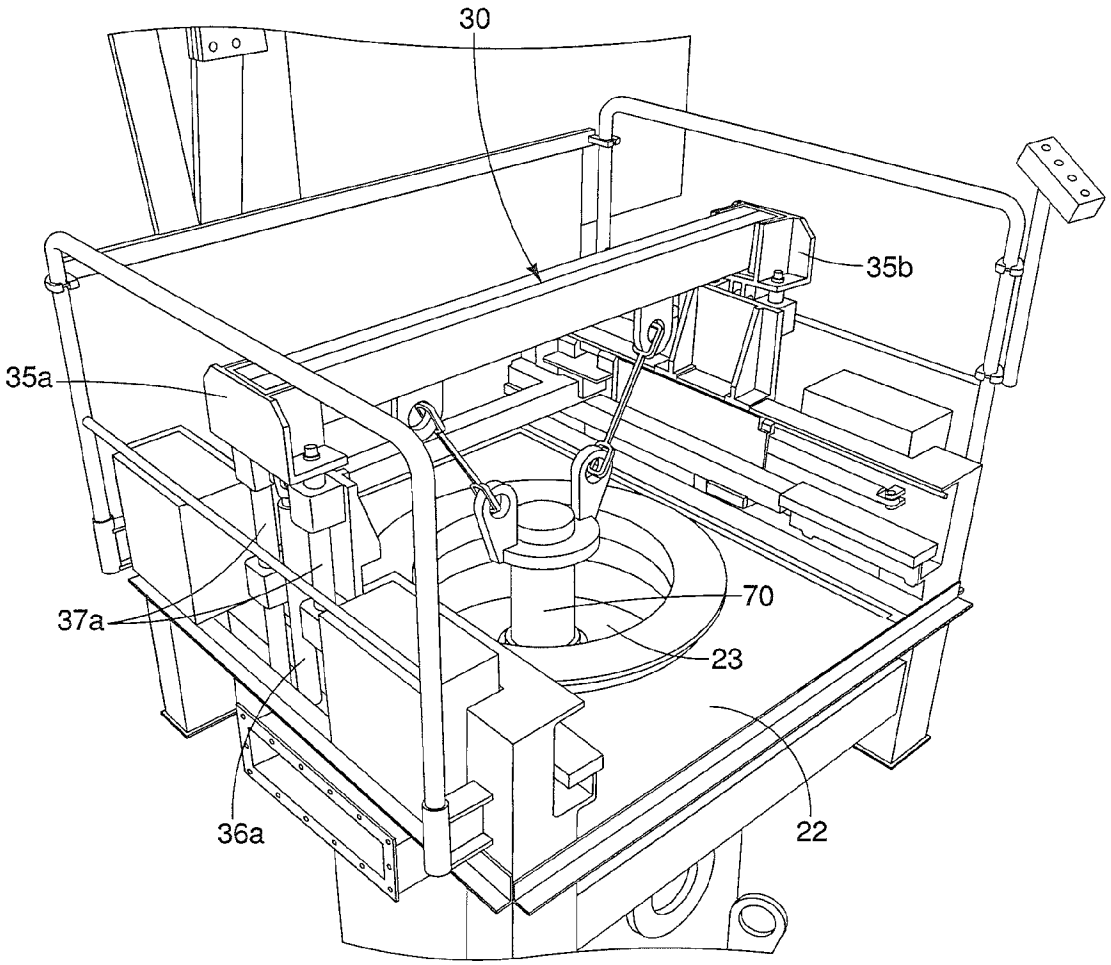

In accordance with one aspect, a work roll 70, as shown in FIG. 3 and FIGS. 6-8, may be positioned within the inner tank 50 in a safer and more accurate manner using systems and methods of the present embodiments. In one exemplary technique, a crane lifts the work roll 70 towards the opening 23 of the platform 22 using a spreader bar 30. An upper portion of the spreader bar 30 is temporarily secured to the crane, e.g., using hooks coupled to the spreader bar 30. A lower portion of the spreader bar 30 is secured to the work roll 70 using a collar 32 and plurality of linkages 33, where the collar 32 is secured to an upper region of the work roll 70 and the linkages 33 extend between the collar 32 and the spreader bar 30, as depicted in FIG. 6.

During initial positioning, the crane lowers the spreader bar 30, and therefore the work roll 70, such that the work roll 70 partially enters the inner tank 50. As the crane lowers the spreader bar 30 further, a first end 30*a* of the spreader bar 30 becomes seated within a recess 34*a* of a first supporting frame 35*a*, and a second end 30*b* of the spreader bar 30 becomes seated within a recess 34*b* of a second supporting frame 35*b*, as seen in FIGS. 1A-1B and FIG. 6. After the crane has lowered the spreader bar 30 into its seated position as supported by the frames 35*a* and 35*b*, the crane is unhooked from engagement with the spreader bar 30.

In a next step, a user may actuate an actuator 36, such as a pneumatic or hydraulic system, that vertically moves the spreader bar 30, and therefore the work roll 70, in a controlled and level manner over a short distance, e.g., the last few inches of positioning within the inner tank 50. In one embodiment, hydraulic cylinders 36*a* and 36*b* are actuated to cause vertical movement of the spreader bar 30. The frame 35*a* that supports the first end 30*a* of the spreader bar 30 may be guided along rails 37*a*, while the frame 35*b* that supports the second end 30*b* of the spreader bar 30 may be guided along rails 37*b*, as best seen in FIG. 1A and FIG. 6. Advantageously, using this guidance system, the work roll 70 is placed in an accurate and level manner within the inner tank 50. Since the level of the chromic acid bath changes as the work roll 70 is inserted into the inner tank 50, this guidance system ensures an exact level of the bath around the work roll 70. As further advantages, the work roll 70 cannot slide during positioning, and is exactly positioned within the inner tank 50 at equidistant positions from a plurality of anodes 90.

Referring still to FIGS. 1A-1B, components of a busbar system 40 are shown and described. The busbar system 40 generally comprises different regions 40*a*, 40*b* and 40*c*. The region 40*a* may be coupled to a rectifier, the region 40*c* is closest to the work roll 70 in operation, and the region 40*b* is generally disposed between the regions 40*a* and 40*c*.

The region 40*c* of the busbar system leads to a lateral plate 41, which in turn is operatively coupled to a plurality of rails 42*a* and 42*b*, as best seen in FIG. 1B. The plurality of rails 42*a* and 42*b* are oriented in a generally perpendicular direction relative to the lateral plate 41. Further, an engaging plate 43 slides in a horizontal direction along the plurality of rails 42*a* and 42*b*. First and second ends of the engaging plate 43 may be coupled to guides 44*a* and 44*b*, which in turn move over the plurality of rails 42*a* and 42*b*, respectively. An actuator 46, such as a pneumatic or hydraulic system, may be used to selectively move the guides 44*a* and 44*b*. In this manner, the engaging plate 43 is guided horizontally along the rails 42*a* and 42*b* into selective engagement with the work roll 70. Advantageously, this provides a safer system to engage a bus component with the work roll 70, as compared to systems where a user must position one or more bus components by hand into engagement with work roll. Accordingly, the risk of user injury is significantly reduced in the present system.

Figure 3:
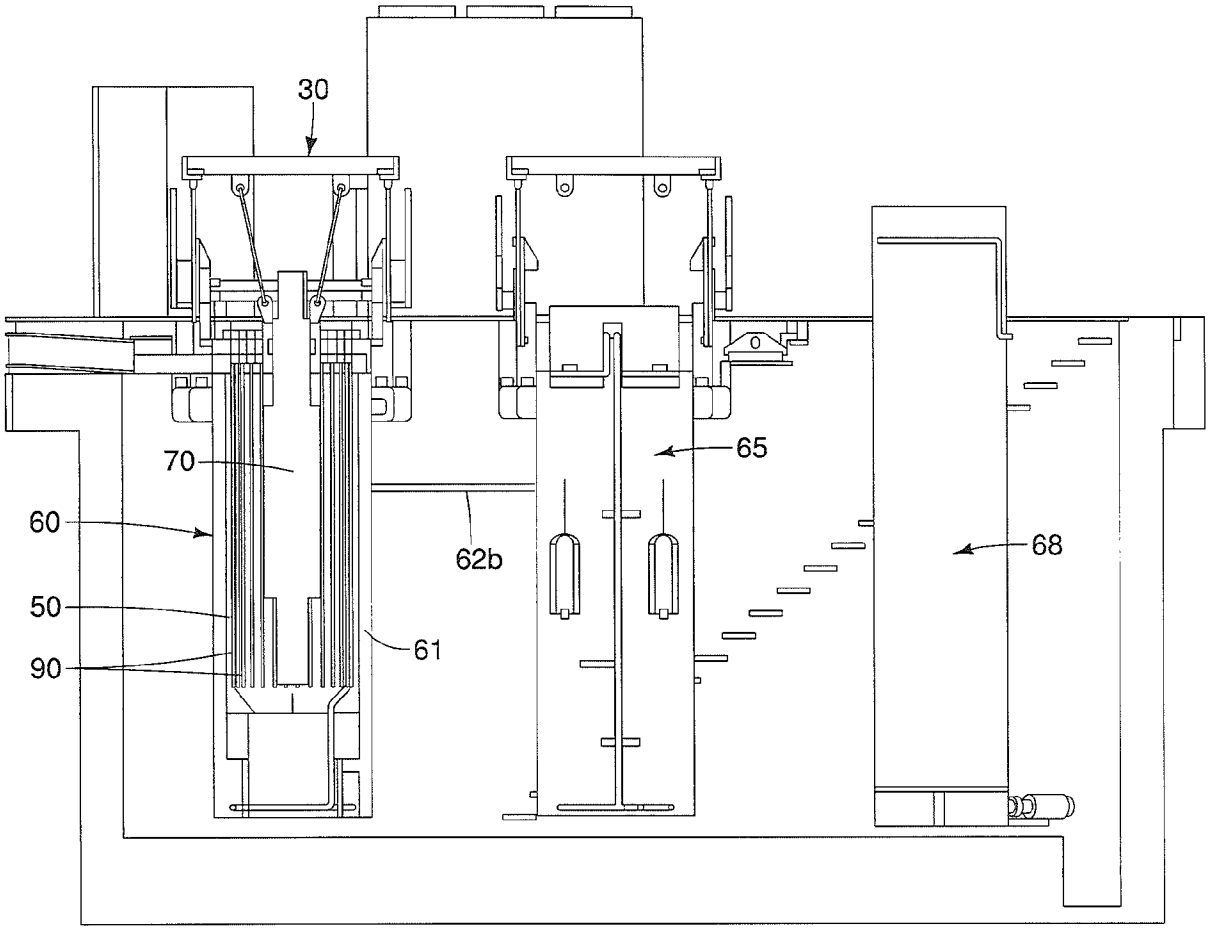
FIG. 3 is a schematic of a temperature regulating tank being used with the inner and outer tanks of FIGS. 2A-2B.

In accordance with another aspect of the invention, the provision of both the inner tank 50 and the outer tank 60 allows an annular space 61 between the two tanks, as best seen in FIG. 2B and FIG. 3. The annular space 61 provides an area for which fluid may be selectively provided to facilitate heating and cooling of the system.

In one embodiment, the annular space 61 is in fluid communication with fluid from a temperature regulating tank 65, as shown in FIG. 3. The temperature regulating tank, which is distinct from the inner and outer tanks 50 and 60, is positioned outside of the outer tank 60. A conduit system including a pump 62*a* and tubing 62*b*, as shown in FIG. 2A and FIG. 3, respectively, may be used to provide fluid communication between the annular space 61 and the temperature regulating tank 65. In the embodiment of FIG. 3, it should be noted that an additional tank 68 is shown, which may be used for dumping or washing purposes.

The temperature regulating tank 65 is provided for heating and cooling purposes, such that fluid within the temperature regulating tank 65 can be provided at a desired temperature and, via the tubing 62*b*, can be provided to the annular space 61 between the inner and outer tanks 50 and 60. Heat transfer of the fluid in the annular space 61, against the material of the inner tank 50, provides a heating or cooling effect upon the chromic acid within the inner tank 50.

Advantageously, since temperature regulation of the chromic acid within the inner tank 50 is achieved via an external tank 65, there is no need to create room for heating and cooling equipment within the inner and outer tanks 50 and 60 themselves. Accordingly, the footprint of the inner and outer tanks 50 and 60 may be significantly reduced.

It may be noted that the temperature regulating tank 65 may comprise a mixture of fluid including water, anti-corrosion elements, or other fluids. The work roll 70 may be placed within the temperature regulating tank 65 prior to being placed within the inner tank 50, for example, in order to warm up the work roll 70 initially and to reduce the heat subsequently required at the inner tank 50 because the work roll 70 is already warm.

Furthermore, in this system, it should be noted that the plating process itself that is occurring in the inner tank 50 creates heat, which can be used to warm up the fluid in the temperature regulating tank 65. In this manner, while one work roll is being plated within the inner tank 50, another work roll can be warmed up within the temperature regulating tank 65 in part by the effect of the plating within the inner tank 50, which significantly increases efficiency of the overall system.

Figure 4B:
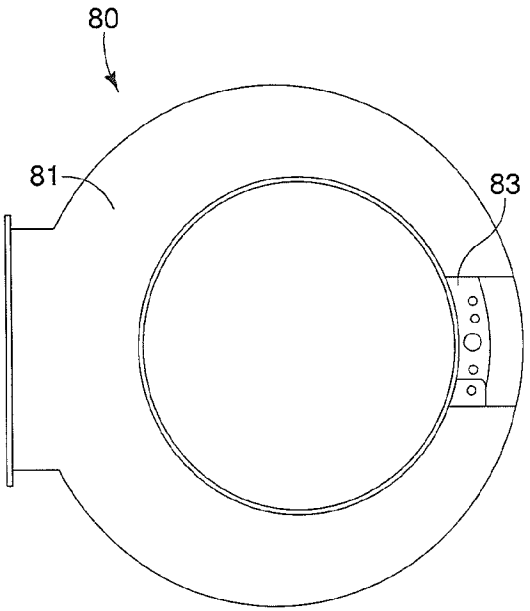
FIGS. 4A-4B are, respectively, perspective and top views of an exhaust hood.
Figure 4A:
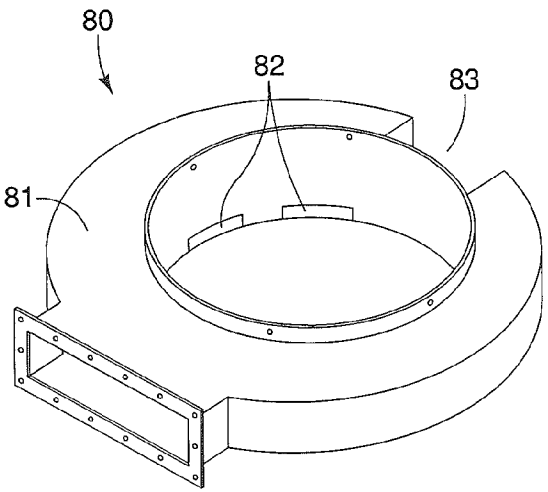

Referring to FIGS. 4A-4B, an exhaust hood 80 is shown and described. The exhaust hood 80 comprises a generally main body having a ring-like shape 81, which is configured to primarily be seated atop the inner tank 50, although it may also cover the outer tank 60. A plurality of slots 82 are formed in the exhaust hood 80 and suction chromic acid fumes or gas bubbles to a scrubber. A notch 83 may be formed in the main body of the exhaust hood 80 to accommodate several components, such as piping or tubing to the inner tank 50 or annular space 61, without increasing the overall circumferential profile of the exhaust hood 80. Advantageously, the exhaust hood 80 significantly reduces the chromic acid fumes that reach the environment outside of the overall system 10.

Figure 5B:
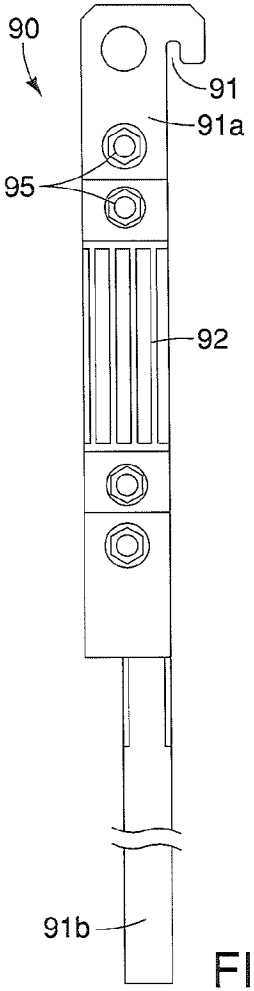
FIGS. 5A-5B are respectively, a side-sectional view of an anode for use with the system for plating work rolls, and a side view of the anode of FIG. 5A rotated approximately 90 degrees.
Figure 5A:
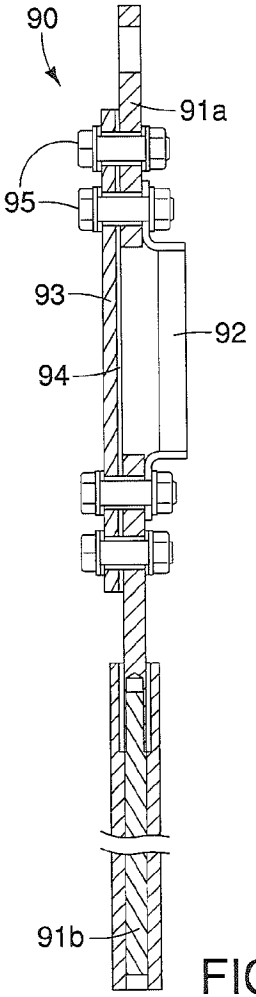

Referring to FIGS. 5A-5B, further features of anodes 90 of the present embodiments are shown and described. The system 10 may comprise about twenty-four total anodes 90, although that number may be greater or fewer depending on a particular application, or as desired by a user. Each of the anodes 90 extends in a generally vertical direction, and may be spaced approximately equidistant from one another around a perimeter of the inner tank 50, for example, as depicted in FIG. 11 and FIGS. 13-15. Each of the anodes 90 is spaced apart a distance, not too close or far apart, from the work roll 70. The anodes 90 may comprises notches 91, depicted in FIG. 5B, that facilitate coupling to the top of the inner tank 50.

At least one of the anodes 90, and preferably each anode, comprises a shunt 92 that separates upper and lower regions 91*a* and 91*b* of the anode 90, as shown in FIG. 5A. The anode 90 is hooked up to a wire that continuously measures amperage. All of the current going to the anode 90 must go through the shunt 92, and is exactly measured. The shunt 92 may span a length of a few inches, whereas an overall length of the anode 90 may be several feet long. The shunt 92 may be placed near the upper region 91*a* of the anode 90, and the lower region 91*b* may extend well below towards the bottom of the inner tank 50.

Advantageously, the system 10 allows for measuring of the amperage of each of the anodes 90 on a consistent basis and with real-time quality control measurements, without use of providing a separate amperage measuring device. Moreover, in prior systems, amperage measurements were taken one anode at a time, but the present embodiments permit multiple simultaneous amperage measurements. Still further, in the present system 10, a strong connection is ensured all the way from the rectifier, through the bus work, and all the way to the anodes 90, allowing for an exact amperage measurement at each anode 90.

In the embodiment of FIGS. 5A-5B, a reinforcing plate 93 may be provided, for example, to account for any potential instability by the provision of the shunt 92. If the reinforcing plate 93 comprises a material such as steel, then an insulating plate 94 may be provided between the reinforcing plate 93 and the remainder of the anode 90, e.g., using a plurality of securing members 95, as shown in FIG. 5A.

Figure 11:
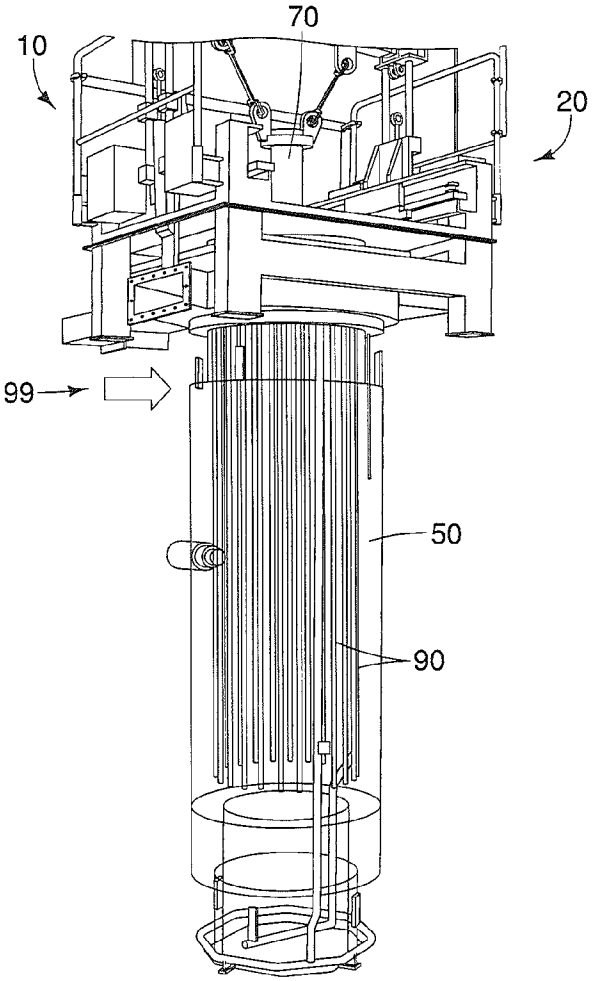
FIG. 11 is a schematic, perspective view illustrating the level of the bath in the inner tank of FIG. 10.

Referring to FIGS. 11-16, systems and techniques for level control of a substance, such as the chromic acid within the inner tank 50, are shown and described. As noted earlier, a guidance system for placing the work roll 70, which includes the actuators 36*a* and 36*b* allowing vertical movement of the spreader bar 30 along rails 37*a* and 37*b*, helps place the work roll 70 in an accurate and level manner within the inner tank 50. In addition to such guidance system, a bladder-type system is described in FIGS. 11-16 that further ensures the chromic acid is level and at the predetermined height within the inner tank 50. FIG. 11 represents a desired level 99 of chromic acid within the inner tank 50, when the work roll 70 is positioned within the inner tank 50.

Figure 12:
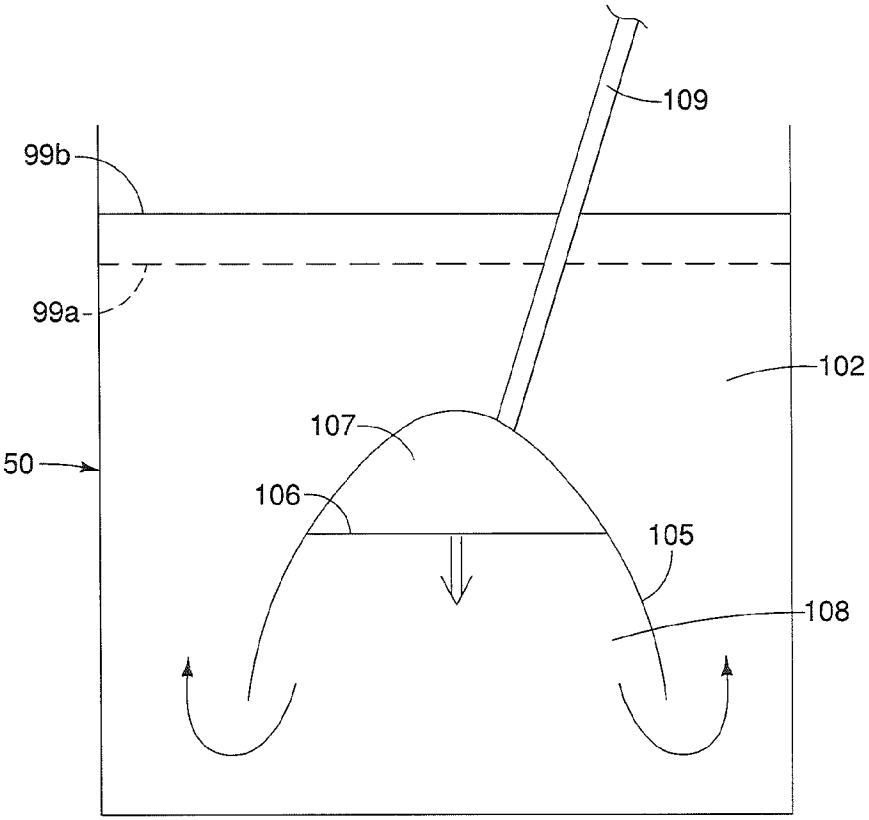
FIG. 12 is a schematic depicting a technique for controlling a bath level within a tank.

FIG. 12 represents a schematic for adjusting the level of the substance, such as chromic acid, to remain at the desired level 99 regardless of the size of the work roll 70 that is placed in the inner tank 50. In the non-limiting embodiment of FIG. 12, a partition 105 is placed near a lower portion of the inner tank 50. The partition has a generally concave shape relative to a lower end of the inner tank 50. A membrane 106 may extend across the partition 105 at locations between its first and second ends, as shown in FIG. 12. A fluid chamber 107 is formed above the membrane 106, and an auxiliary chamber or bath surplus area 108 is formed beneath the membrane 106, as depicted in FIG. 12. Tubing 109 is in fluid communication with the fluid chamber 107.

In operation, fluid such as air is introduced into the fluid chamber 107 via the tubing 109, causing the membrane 106 to be urged in a downward direction, thereby displacing at least some of the chromic acid within the bath surplus area 108 towards the main reservoir 102 of the inner tank 50, in the direction of the curved arrows. This, in turn, raises the level of chromic acid within the main reservoir 102 from a first level 99*a* to a second level 99*b*, as depicted in FIG. 12. Such a technique may be used when a relatively small work roll 70 is introduced into the inner tank 50 and it is necessary to use the bath surplus area 108 to maintain the desired level 99. In contrast, if a relatively large work roll 70 is introduced into the inner tank 50, fluid may be removed from the fluid chamber 107, thus relaxing the membrane 106 and allowing chromic acid to fill within the bath surplus area 108, thereby decreasing the effective amount of chromic acid within the main reservoir 102 to maintain the desired level 99.

Advantageously, using a bladder-type control in this manner, the inner tank 50 is able to plate work rolls of any size, at a desired chromic acid level, by simple adjustments relating to adding or withdrawing fluid from the chamber 107. As a further advantage, such a bladder-type control system eliminates the requirement of Weir walls that are conventionally used to prevent overflow of chromic acid from a tank, and further eliminates pumping of chromic acid.

Figure 13:
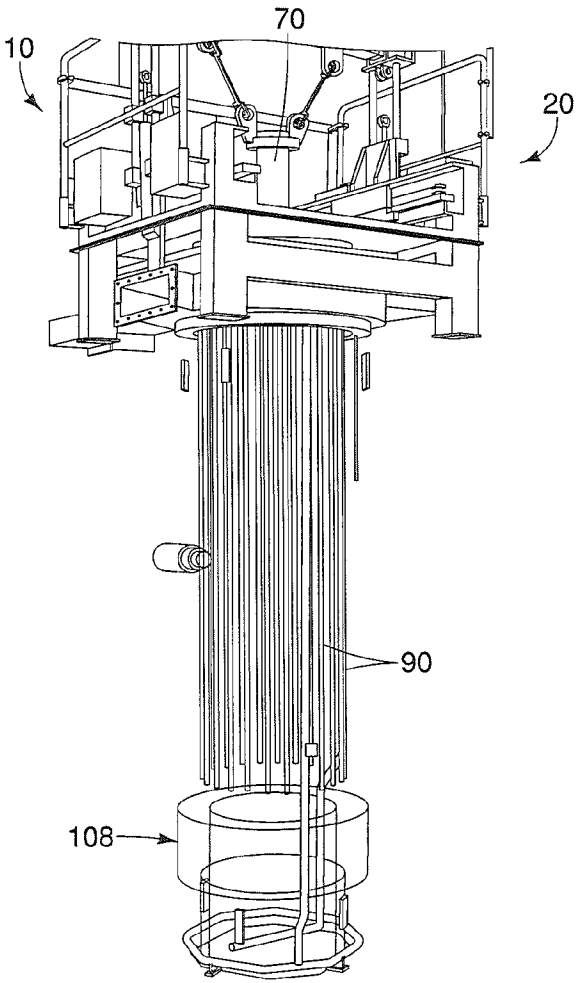
FIG. 13 is a perspective view illustrating the level of a bath in a chamber of the inner tank of FIG. 10.
Figure 14:
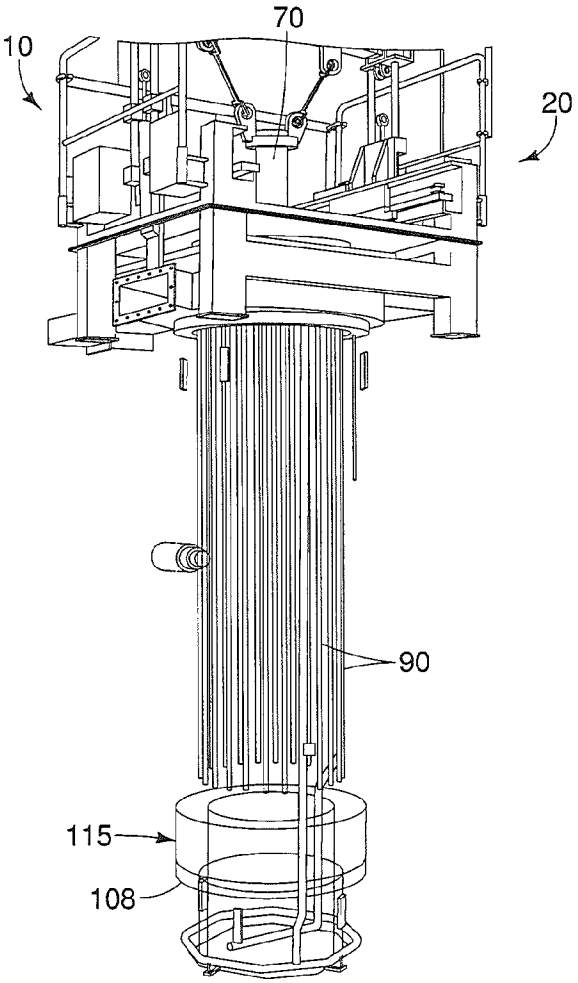
FIG. 14 is a schematic, perspective view illustrating fluid displacing the bath in the chamber of FIG. 13.
Figure 15:
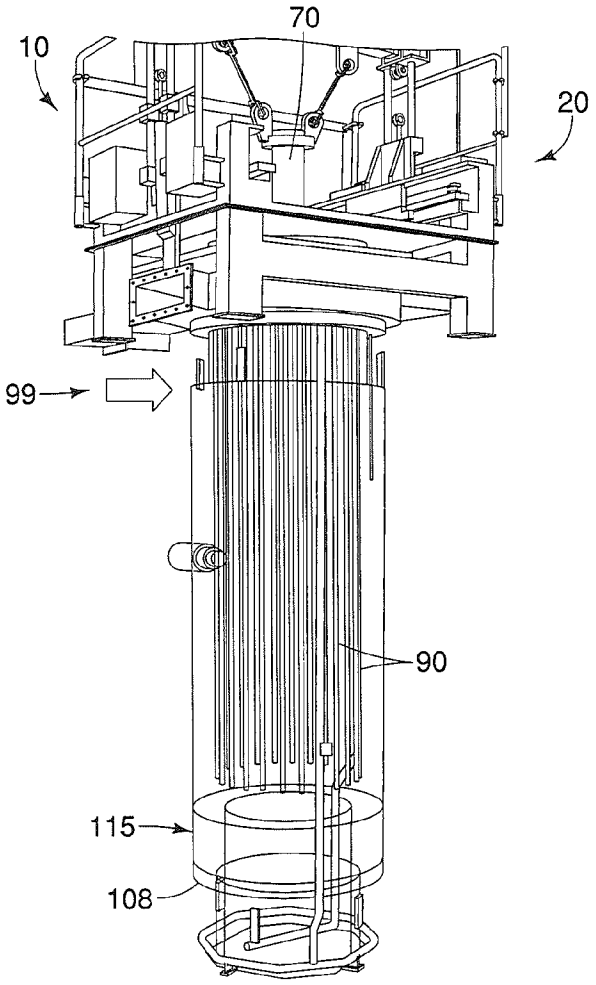
FIG. 15 is a schematic, perspective view illustrating the level of the bath in a main reservoir after providing the fluid into the chamber in FIG. 14.

Referring to FIGS. 13-16, an embodiment is shown that implements level control principles of the bladder-type control system of FIG. 12. In FIG. 13, a lower chamber forms an auxiliary reservoir or bath surplus area 108 at a location within the inner tank 50 (although the inner tank 50 is omitted for clarity). In FIG. 14, fluid 115, for example air, has been introduced above the lower chamber 108, thus displacing the chromic acid within the bath surplus area 108, such that extra chromic acid fills the main reservoir of the inner tank 50. As shown in FIG. 15, in this manner, the desired level 99 of chromic acid within the inner tank 50 may be maintained using such bladder-type control system.

Figure 16:
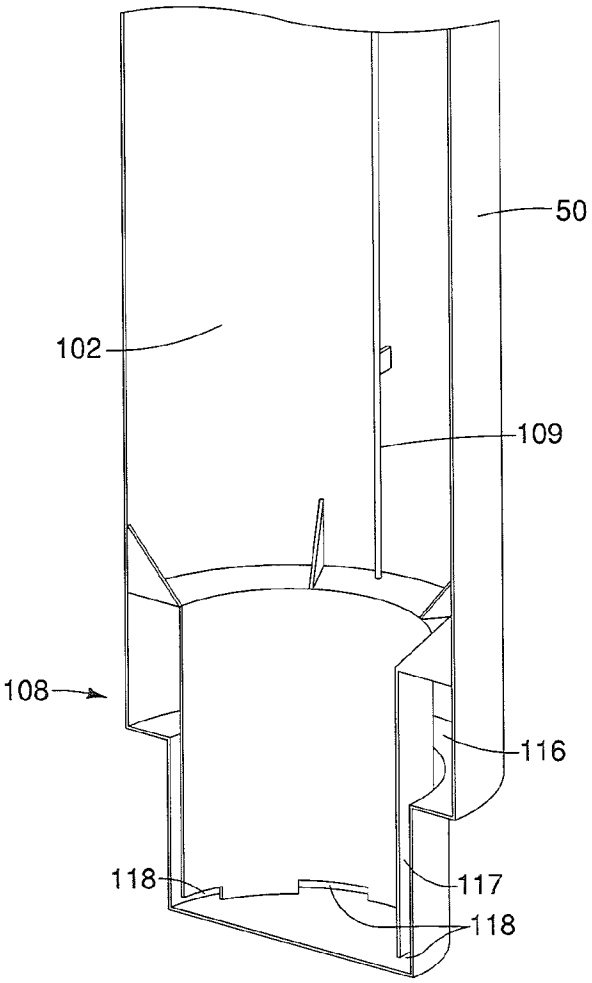
FIG. 16 is a cut-away view illustrating a lower portion of an inner tank.

In FIG. 16, an exemplary contour of the auxiliary reservoir or lower chamber 108 of FIGS. 13-15 is shown and described. The lower chamber 108 has an upper area 116, a lower area 117 that may be narrower than the upper area 116, and a plurality of openings 118 that allow transfer of chromic acid between the lower chamber 108 and the main reservoir 102. Specifically, when fluid, for example air, is introduced via the tubing 109 to a location near or at the top of the lower chamber 108, then a surplus of chromic acid is displaced downward by the introduction of the fluid. In particular, the surplus of chromic acid within the chamber 108 flows in a direction from the upper area 116, towards the lower area 117, and through the plurality of openings 118, and into the main reservoir 102, thus increasing the amount of chromic acid within the main reservoir 102. In contrast, removal of fluid via the tubing 109 allows chromic acid to flow back towards the upper area 116 of the chamber 108, thus decreasing the amount of chromic acid within the main reservoir 102.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A system for plating of work rolls, the system comprising:

a tank having a main reservoir dimensioned to receive a work roll;

a chamber positioned within the tank, wherein introduction of a fluid towards the chamber urges a surplus of a substance within the chamber towards the main reservoir of the tank, and wherein removal of fluid from the chamber allows a portion of the substance within the main reservoir of the tank to fill the chamber, wherein a membrane separates the fluid from the substance; and an anode having a shunt incorporated into the anode, wherein current going to the anode passes through the shunt.

2. The system of claim 1, wherein the tank is an inner tank, wherein the system further comprises an outer tank, and wherein the inner tank is disposed coaxially within the outer tank.

3. The system of claim 1, further comprising an exhaust hood disposed over a perimeter of the tank, the exhaust hood comprises a generally ring-shaped profile having a plurality of slots formed therein to suction fumes from the tank.

4. The system of claim 1, further comprising at least one actuator operatively disposed for incremental vertical positioning of a work roll within the tank.

5. The system of claim 1, wherein the chamber is defined by a partition that is placed in a lower portion of the tank and the membrane is disposed below and across the partition to define a fluid chamber above the membrane and below the partition, and further comprising tubing in fluid communication with the fluid chamber.

6. The system of claim 5, wherein when fluid is urged into the fluid chamber the membrane is urged in a downward direction within the tank.

7. The system of claim 1, wherein the anode comprises an upper region and a lower region, wherein the shunt separates the upper and lower regions of the anode.

8. A system for plating of work rolls, the system comprising:

a tank having a main reservoir dimensioned to receive a work roll;

a chamber positioned within the tank, wherein introduction of a fluid towards the chamber urges a surplus of a substance within the chamber towards the main reservoir of the tank, and wherein removal of fluid from the chamber allows a portion of the substance within the main reservoir of the tank to fill the chamber, wherein the chamber is defined by a partition that is placed in a lower portion of the tank and a membrane is disposed below and across the partition to define a fluid chamber above the membrane and below the partition, and further comprising tubing in fluid communication with the fluid chamber; and an anode having a shunt incorporated into the anode, wherein current going to the anode passes through the shunt.

9. The system of claim 8, wherein the anode comprises an upper region and a lower region, wherein the shunt separates the upper and lower regions of the anode.

10. The system of claim 8, further comprising an exhaust hood disposed over a perimeter of the tank, the exhaust hold comprises a generally ring-shaped profile having a plurality of slots formed therein to suction fumes from the tank.

11. The system of claim 8, wherein the tank is an inner tank, wherein the system further comprises an outer tank, and wherein the inner tank is disposed coaxially within the outer tank.

12. The system of claim 11, wherein the outer tank comprises a cylindrical shape, and wherein an annular space is formed between the inner tank and the outer tank, wherein temperature regulating fluid is disposed within the annular space.

13. The system of claim 8, wherein when fluid is urged into the fluid chamber the membrane is urged in a downward direction within the tank.

14. The system of claim 8, further comprising a plurality of anodes, wherein each of the plurality of anodes comprises a shunt incorporated into the anode, wherein each of the plurality of anodes further comprises an upper region and a lower region, wherein the shunt separates the upper and lower regions of the anode.

* * * * *